US008322711B2

(12) United States Patent
Hayama et al.

(10) Patent No.: US 8,322,711 B2
(45) Date of Patent: Dec. 4, 2012

(54) IMAGE FORMING APPARATUS

(75) Inventors: Satoru Hayama, Osaka (JP); Chikashi Kajikawa, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 13/220,817

(22) Filed: Aug. 30, 2011

(65) Prior Publication Data

US 2012/0049439 A1 Mar. 1, 2012

(30) Foreign Application Priority Data

Aug. 31, 2010 (JP) ..... P2010-194811
Aug. 31, 2010 (JP) ..... P2010-194812

(51) Int. Cl.
*B65H 1/00* (2006.01)

(52) U.S. Cl. ..... 271/162; 271/145

(58) Field of Classification Search ..... 271/145, 271/162, 164
See application file for complete search history.

(56) References Cited

U.S. PATENT DOCUMENTS

2010/0294824 A1 11/2010 Takemura et al. ..... 227/3

FOREIGN PATENT DOCUMENTS

JP 2008-216829 9/2008
JP 2009-184076 8/2009

*Primary Examiner* — Michael McCullough
(74) *Attorney, Agent, or Firm* — Ostrolenk Faber LLP

(57) ABSTRACT

An image forming apparatus in accordance with the present invention includes a vibration sensor that transmits a detection signal in response to a vibration pattern and a sheet feeder cassette unit that stores recording papers, is opened/closed by extraction/insertion, and generates a specific vibration pattern while being opened or closed. The image forming apparatus includes an open/close detector unit that detects an opened/closed state of the sheet feeder cassette unit when detecting a predetermined vibration pattern based on the detection signal of the vibration sensor.

8 Claims, 7 Drawing Sheets

IMAGE FORMING APPARATUS

Priority is claimed on Japanese Unexamined Patent Application, First Publication No. 2010-194811 and No. 2010-194812, filed Aug. 31, 2010, the contents of which are incorporated herein by reference.

BACKGROUND OF THE INVENTION

1. Field of the Invention

The present invention relates to an image forming apparatus that includes an open/close detecting unit that detects sheet feeder cassette units.

2. Description of the Related Art

In recently years, saving energy is loudly advocated in society and is in demand with regard to image forming apparatuses. Therefore, recent image forming apparatuses provide a sleep mode that restricts energy consumption by supplying power to the minimum required functions. For example, the image forming apparatus includes sheet feeder cassette units for storing recoding papers, where each sheet feeder cassette unit is provided with an open/close sensor for detecting an open/closed state of the sheet feeder cassette unit. In sleep mode, power is supplied to the minimum required function parts such as the open/close sensor, a circuit engine board that is a control circuit including a CPU (Central Processing Unit), which receives a detecting signal from the open/close sensor, or the like. This approach intends to save energy in the image forming apparatus. For example, Japanese Patent Applications No. 2009-184076 and No. 2008-216829 propose methods of conserving energy based on the sleep mode.

However, in the related art described above, power needs to be supplied to multiple open/close sensors for respectively detecting open/closed states of each sheet feeder cassette units. In such a case, the power consumption in a sleep mode increases with an increase in the number of sheet feeder cassette units. Furthermore, in the case of an optional sheet feeder cassette unit apparatus that is attached to the main body of an image forming apparatus as optional equipment, another control circuit having a CPU is included for controlling the optional sheet feeder cassette unit apparatus separately from the main body of the image forming apparatus. Further, the optional sheet feeder cassette unit apparatus includes an engine substrate that includes a CPU separately from the main body of the image forming apparatus. The CPUs control operations in the optional sheet feeder cassette unit apparatus via serial communication between the main body of the image forming apparatus and the optional sheet feeder cassette unit apparatus. For restarting the optional sheet feeder cassette unit apparatus from sleep mode by opening/releasing the sheet feeder cassette unit, power needs to be maintained to both the control circuit of the main body of the imaging apparatus and the engine substrate of the optional sheet feeder cassette unit apparatus. For this purpose, power needs to be supplied to the engine substrate and the open/close sensor of the optional sheet feeder cassette unit apparatus even in sleep mode. In this manner, the image forming apparatus according to the above related art requires power supply to the sheet feeder cassette unit apparatus even in sleep mode for detecting the open/closed state of the sheet feeder cassette unit. This increases power consumption of the image forming apparatus of the related art.

The present invention takes into consideration the issues described above. For example, one of the objects of the present invention is to reduce power consumption of an image forming apparatus for detecting a state of being open/closed when a sheet feeder cassette unit is in a sleep mode.

SUMMARY OF THE INVENTION

Accordingly, it is a primary object of the present invention to provide an image forming apparatus which is configured to include a sheet feeder cassette unit being opened or closed by extracting or inserting the sheet feeder cassette unit. The image forming apparatus includes a vibration sensor configured to transmit detection signals in response to vibration patterns, and an open/close detection unit configured to detect an open/close state of the sheet feeder cassette unit based on a detection result of the vibration sensor. The sheet feeder cassette unit generates a first specific vibration pattern when the sheet feeder cassette unit is opened or closed, and the open/close detection unit identifies the first specific vibration pattern based on a detection signal of the vibration sensor and detects the open/close state of the sheet feeder cassette unit based on an identification of the first specific vibration pattern.

According to an image forming apparatus of the present invention, the image forming apparatus can reduce the consumption of electric power supplied for detecting an open/close state of sheet feeder cassette units in sleep mode.

BRIEF DESCRIPTION OF THE DRAWINGS

Referring now to the attached drawings which form a part of this original disclosure.

DETAILED DESCRIPTION OF THE INVENTION

Selected embodiments of the present invention will now be described with reference to the drawings. It will b e apparent to those skilled in the art from this disclosure that the following descriptions of the embodiments of the present invention are provided for illustration only and not for the purpose of limiting the invention as defined by the appended claims and their equivalents.

With reference to the figures, a description will be given below for a first embodiment in accordance with the preset invention.

Figure 1:
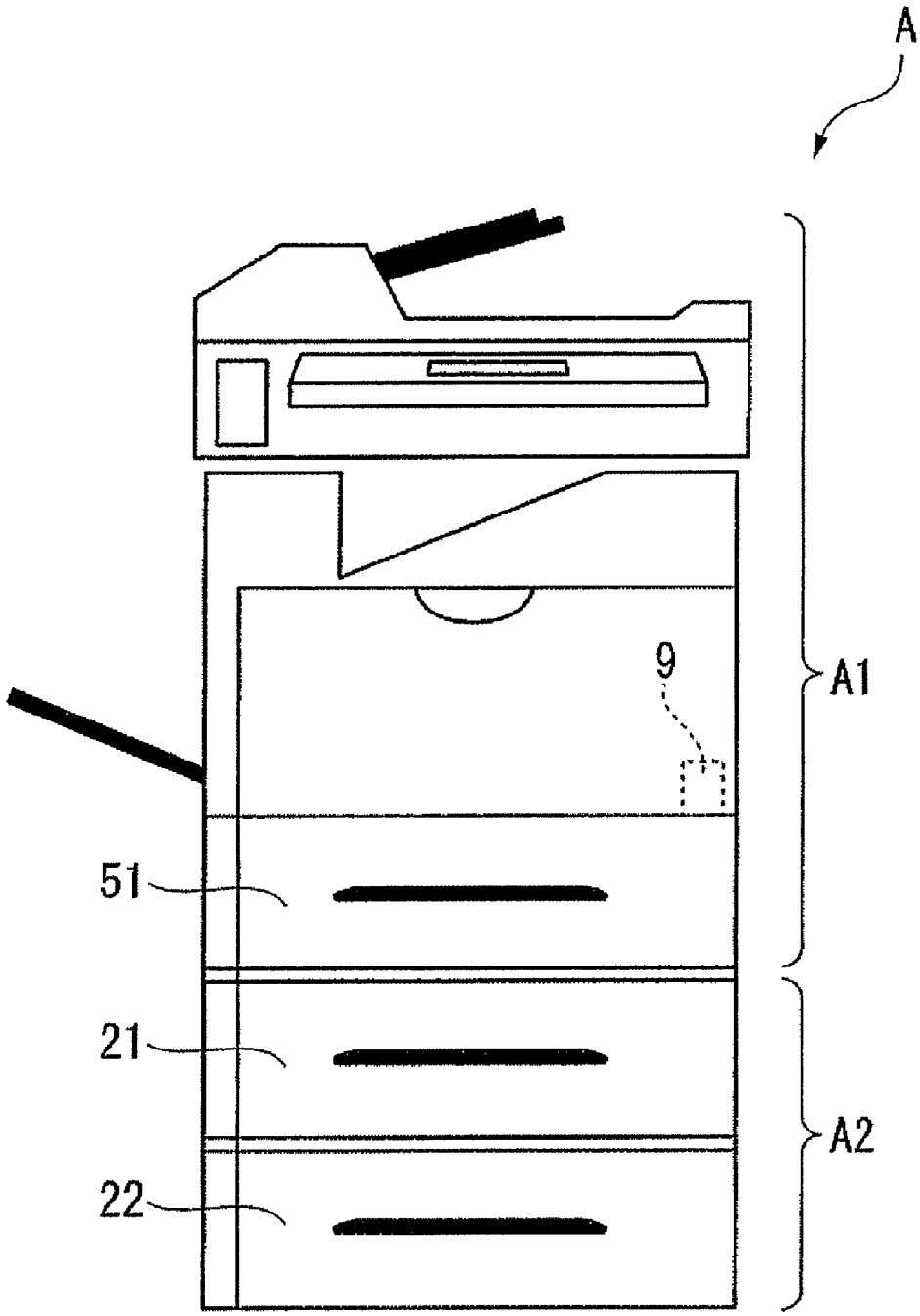
FIG. 1 is a drawing that illustrates a front view of an image forming apparatus in accordance with a first embodiment of the present invention.
Figure 2:
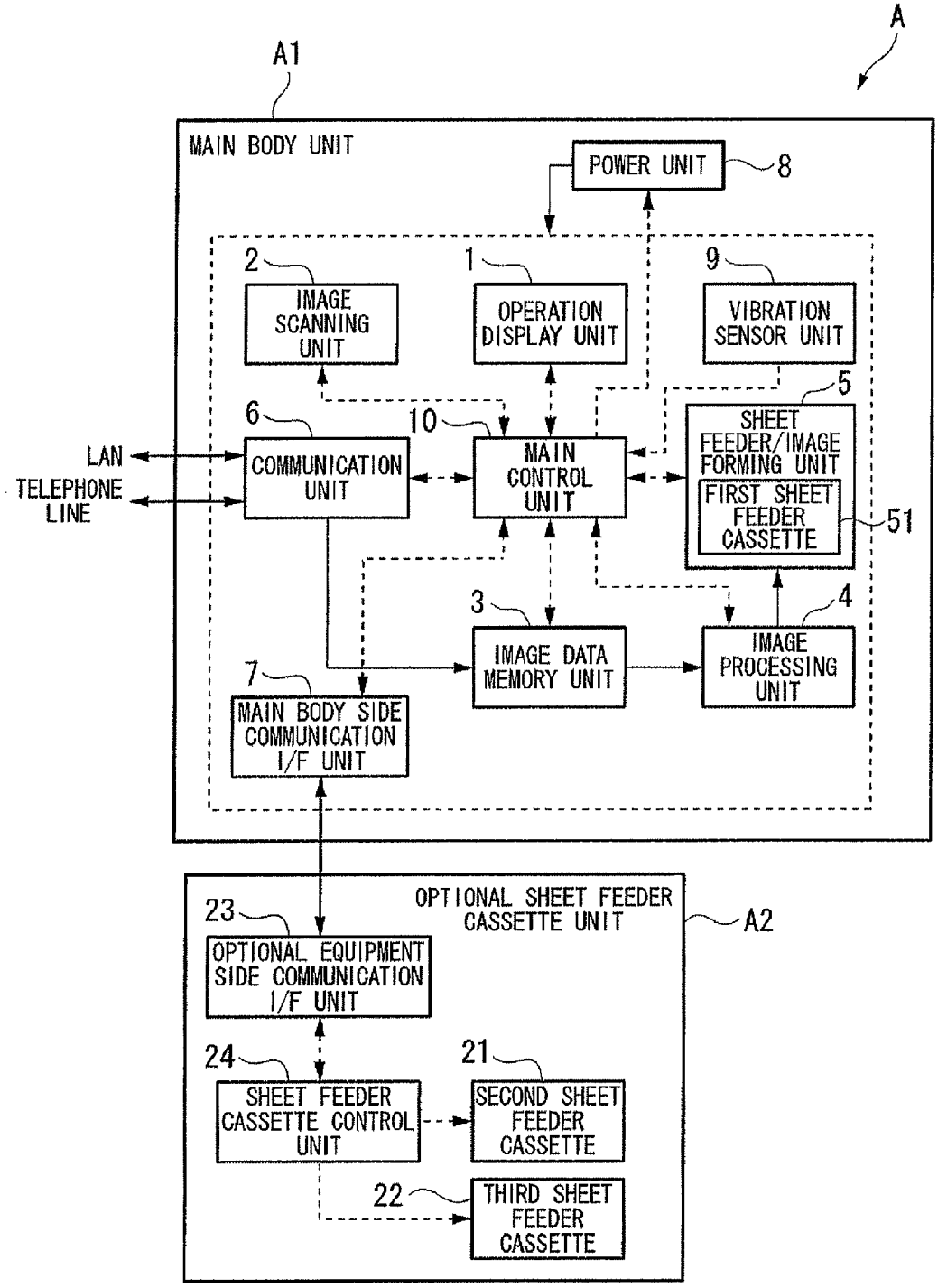
FIG. 2 is a drawing that illustrates a block diagram of an image forming apparatus in accordance with a first embodiment of the present invention.

A multi-functional apparatus (image forming apparatus) A in accordance with the first embodiment includes a copy function, a print function, a scanning function, and facsimile transmission/reception function. As shown in FIG. 1 and FIG. 2, the multi-functional apparatus A includes a main body unit A1 that performs an image forming process and an optional sheet feeder cassette unit apparatus A2 (optional sheet feeder cassette unit A2) that feeds recoding paper to the main body unit A1.

The main body unit A1 performs the image forming process as a primary processing. The main body unit A1 includes an operation display unit 1, an image scanning unit 2, an image data memory unit 3, an image processing unit 4, a sheet feeder/image forming unit 5, a communication unit 6, a main body communication I/F unit 7, a power unit 8, a vibration sensor unit 9, and a main control unit 10, as shown in FIG. 2. The main control unit 10 is an open/close detecting unit and a power control unit of the first embodiment.

The operation display unit 1 includes operation keys and a touch panel, which functions as an interface that associates between a user and the multifunctional apparatus A. The operation display unit 1 outputs an instruction signal of each pushed down key to the main control unit 10, and indicates various screens on the touch panel based on the control signals of the main control unit 10.

The image scanning unit 2 scans a manuscript (manuscript image) to read the image of the manuscript by using a line sensor, in which the manuscript is automatically fed by a document processor (DP: document processor or automatic manuscript feed apparatus) based on a control signal input from the main control unit 10 or placed on a platen glass. The image scanning unit 2 converts the scanned image into a manuscript image data, and outputs the manuscript image data to the image data memory unit 3.

The image data memory unit 3 is a semiconductor memory or a hard disk drive apparatus. The image data memory unit 3 stores the manuscript image data, a print image data and a facsimile image data (receiving through the communication unit 6 from the outside) based on the control signal input from the main control unit 10, and outputs the image data to the image processing unit 4.

The image processing unit 4 performs various image processing (e.g. image processing of an enlarged or reduced copy) for the image data that is input from the image data memory unit 3 based on the control signal input from the main control unit 10. The image processing unit 4 converts the image data into an image data of an image formation format (image formation format data), and transmits the image formation data to the sheet feeder/image forming unit 5. When the image scanning unit 2 reads a color manuscript, an image data from the image data memory unit 3 input to the image processing unit 4 becomes an RGB image data (color image data) corresponding to the three primary colors of light.

The image processing unit 4 converts the RGB image data into an image data corresponding to an image formation format (image formation format data), such as a YMCK image data that is an image data consisting of primary colors, i.e. Y(yellow), M(magenta), C(cyan), and K(black), and transmits the YMCK image data to the sheet feeder/image formation unit 5.

The sheet feeder/image formation unit 5 includes a first sheet feeder cassette unit 51 that stores recording paper of a predetermined kind of paper, a print engine (a photoconductor drum, an electrification unit, a development unit, a fixation unit or the like), a sheet feeder roller, and a paper exhaust roller, as shown in FIGS. 1 and 2. The sheet feeder/image formation unit 5 feeds the recording paper using the sheet feeder roller based on the control signal of the main control unit 10. The sheet feeder/image formation unit 5 transcribes an image on a recording paper based on the image data input from the image processing unit 4 and performs fixation the image on the recording paper. The sheet feeder/image formation unit 5 transfers the recording paper to the outside of the apparatus by the exhaust roller.

Figure 3:
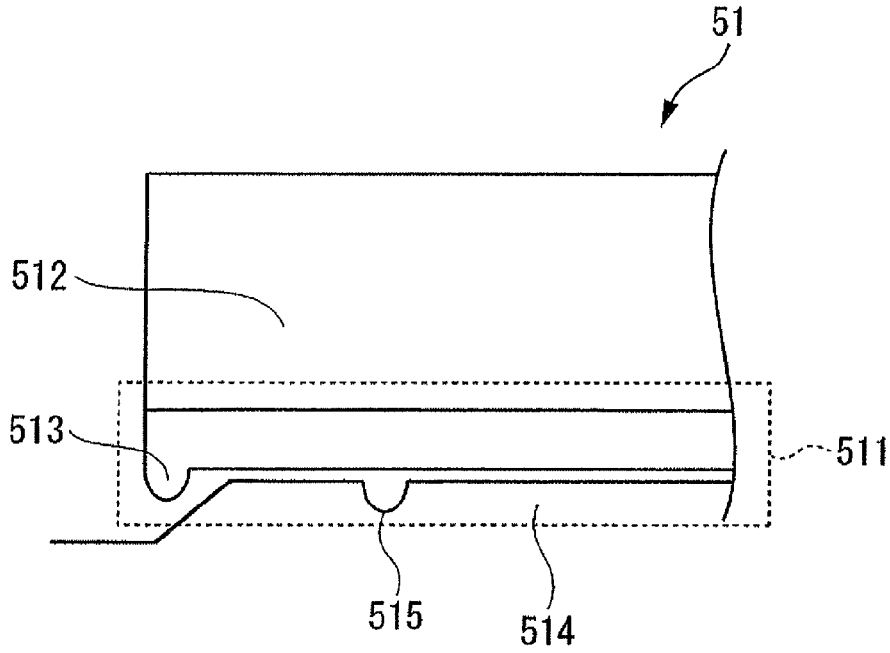
FIG. 3 is a drawing that illustrates a guide rail of a first sheet feeder cassette unit of an image forming apparatus in accordance with a first embodiment of the present invention.

The first sheet feeder cassette unit 51 includes a guide rail 511, a paper storage unit 512, and a support unit 514 as shown in FIG. 3. The guide rail 511 guides the paper storage unit 512 when the paper storage unit 512 is opened/closed. A convex portion 513 is formed on a surface of the paper storage unit 512, while a concave portion 515 (a first concave portion) is formed on a surface of the support unit 514. At the engagement surface of the guide rail 511, a specific vibration pattern is generated by making the convex portion 513 engage with the concave portion 515 when the paper storage unit 512 is extracted/inserted.

The communication unit 6 can communicate with a facsimile machine, a client computer or the like by use of a LAN (Local Area Network) or a telephone line based on the control signal of the main control unit 10. In particular, the communication unit 6 includes both communication functions in accordance with the LAN standard such as the Ethernet (trade mark) and the facsimile standard such as the G3 (third generation) standard. The communication unit 6 can perform transmission of electronic mail (Emails) or transmission/reception of facsimiles.

The main body communication I/F unit 7, which is connected to the optional sheet feeder cassette unit apparatus A2 through a serial cable, is an interface that communicates with the optional sheet feeder cassette unit apparatus A2 based on the control signal input from the main control unit 10.

The power unit 8 supplies electric power to the main body unit A1 and the optional sheet feeder cassette unit apparatus A2 based on the control signal input from the main control unit 10, in which the electric power is introduced from the outside. The vibration sensor unit 9 is placed to face the first sheet feeder cassette unit 51 at the inside of the main body unit A1, and detects the vibration generated at the main body unit A1 and the optional cassette apparatus A2. The vibration sensor 9 outputs a detection signal to the main control unit 10 in response to a vibration pattern of the multifunctional apparatus A.

For example, the vibration sensor unit 9 may be an acceleration sensor.

The main control unit 10 includes a CPU (Central Processing Unit), a ROM (Read Only Memory), a RAM (Random Access Memory), the operation display unit 1, the image scanning unit 2, the image data memory unit 3, the image processing unit 4, the sheet feeder/image forming unit 5, and an interface circuit performing signal input/output between the communication unit 6 and the main body communication I/F unit 7. The main control unit 10 performs the whole control of the multifunctional apparatus A based on the control program stored in the ROM and the operation instructions input from the operation display unit 1. Further, the control program stored in the ROM includes a trouble shooting program. The main control unit 10 performs a processing based on the trouble shooting program when failure is detected at the optional sheet feeder cassette unit apparatus A2 or the like. For the operations of the multifunctional apparatus A, a description will be given in detail based on the processing performed by the main control unit 10.

The optional sheet feeder cassette unit apparatus A2 is an optional apparatus that is removable, and stores recording papers which are conveyed to the sheet feeder/image forming unit 5. The optional sheet feeder cassette unit apparatus A2 includes a second sheet feeder cassette unit 21, a third sheet feeder cassette unit 22, a device side communication I/F unit 23 (an optional equipment side communication I/F unit 23) and a sheet feeder control unit 24, as shown in FIG. 1.

The second sheet feeder cassette unit 21, which is similar to the first sheet feeder cassette unit 51, includes a guide rail that guides the second sheet feeder cassette unit 21 when the second sheet feeder cassette unit 21 is extracted/inserted for opening/closing the sheet feeder cassette unit 21. The second sheet feeder cassette unit 21 includes a convex portion on a surface of a paper storage unit at an engagement surface of the guide rail and a concave portion on a surface of a support side of a paper storage support unit at the engagement surface of the guide rail. In this way, the second sheet feeder cassette unit 21 provides a structure that generates a specific vibration pattern by making the convex portion fit into the concave portion while the second sheet feeder cassette unit 21 is extracted/inserted. The third sheet feeder cassette unit 22 includes a similar structure to the second sheet feeder cassette unit 21.

The device side communication I/F unit 23 is an interface that performs communication with the main body unit A 1 based on a control signal input from the sheet feeder cassette unit control unit 24. The optional equipment side communication side I/F unit 23 is connected to the main body side communication I/F unit 7 via a serial cable.

The sheet feeder cassette unit control unit 24 includes a CPU, a ROM, a RAM, the second sheet feeder cassette unit 21, the third sheet feeder cassette unit 22, the device side communication I/F unit 23, and an interface circuit that performs signal input/output with the device side communication I/F unit 23. The sheet feeder cassette unit control unit 24 controls the total operations of the optional sheet feeder cassette unit apparatus A2 based on the control program stored in the ROM and the control signal input from the main control unit 10 via the device side communication I/F unit 23.

The operations of the multifunctional apparatus in accordance with the first embodiment, which include the configuration shown above, will be described in detail below.

In the multifunctional apparatus A, the main control unit 10 totally sets the multifunctional apparatus A in a sleep mode when the operation display unit 1 is not operated by a user. In other words, the main control unit 10 suspends the power supply to each of units except the operation display unit 1, the vibration sensor unit 9 and the main control unit 10. That is, the main control unit 10 makes the power unit 8 stop supplying the electric power to the image scanning unit 2, the image data memory unit 3, the image processing unit 4, the sheet feeder /image forming unit 5, the communication unit 6 and the main body side communication I/F unit 7. Further, the main control unit 10 stops supplying the electric power to the optional sheet feeder cassette unit apparatus A2 through the main body side communication I/F unit 7. Thereby, the optional sheet feeder cassette unit apparatus A2 becomes completely in a shutdown state. When the whole multifunctional apparatus A enters sleep mode, the main control unit 10 maintains the sleep mode until the operation display unit 1 receives an operation instruction or until the first sheet feeder cassette unit 51, the second sheet feeder cassette unit 21 of the optional sheet feeder cassette unit apparatus A2 or the third sheet feeder cassette unit 22 of the optional sheet feeder cassette unit apparatus A2 is opened or closed.

After the multifunctional apparatus A enters sleep mode, when the first sheet feeder cassette unit 51 is opened/closed by extraction or insertion, a specific vibration pattern is generated by the convex portion 513 fitting into the concave portion 515. When the second sheet feeder cassette unit 21 or the third sheet feeder cassette unit 22 is opened/closed by extraction or insertion, a specific vibration pattern is generated, which is similar to the first sheet feeder cassette unit 51. When the vibration sensor unit 9 detects the specific vibration pattern generated by opening or closing the first sheet feeder cassette unit 51, the second sheet feeder cassette unit 21 or the third sheet feeder cassette unit 22, the vibration sensor unit 9 transmits a detection signal in response to the vibration pattern to the main control unit 10. When the main control unit 10 receives a detection signal from the vibration sensor unit 9 and detects the specific vibration pattern based on the detection signal, the main control unit 10 detects the first sheet feeder cassette unit 51, the second sheet feeder cassette unit 21 or the third sheet feeder cassette unit 22 is opened/closed. When the main control unit 10 detects that the first sheet feeder cassette unit 51, the second sheet feeder cassette unit 21 or the third sheet feeder cassette unit 22 is opened/closed, the main control unit 10 restores the multifunctional apparatus A from sleep mode. In other words, the main control unit 10 makes the power unit 8 restart the supply of electric power to the image scanning unit 2, the image data memory unit 3, the image processing unit 4, the sheet feeder/image forming unit 5, and the main body side communication I/F unit 7. Further, the main control unit 10 restarts the supply of electric power to the optional sheet feeder cassette unit A2 through the main body side communication I/F unit 7. Thereby, the optional sheet feeder cassette unit A2 becomes in an operation ready state.

As is described above, in the multifunctional apparatus A in accordance with the present embodiment, the main control unit 10 detects that the first sheet feeder cassette unit 51, the second sheet feeder cassette unit 21 or the third sheet feeder cassette unit 22 is opened/closed when the main control unit 10 detects the specific vibration pattern based on a detection result of the vibration sensor unit 9. Accordingly, by detecting that the first sheet feeder cassette unit 51, the second sheet feeder cassette unit 21 or the third sheet feeder cassette unit 22 is opened/closed based on the detection result of the vibration sensor unit 9, there becomes no need to provide open/close sensors for each of the first sheet feeder cassette unit 51, the second sheet feeder cassette unit 21 and the third sheet feeder cassette unit 22, so that the power required to operate the open/close sensors can be reduced. Furthermore, as there is no need to supply the electric power to the sheet feeder cassette unit control unit 24 of the optional sheet feeder cassette unit A2 while being in sleep mode, the electric power required for the sheet feeder cassette unit control unit 24 can be reduced.

Up to now, although the descriptions have been given for the first embodiment, the present invention is not limited to the above embodiment, for example, modifications can be made as follows.

Although, in the first embodiment, there is no identification made for detecting which of the first sheet feeder cassette unit 51, the second sheet feeder cassette unit 21 and the third sheet feeder cassette unit 22 is opened/closed, the present invention is not limited to these configurations.

Figure 4:
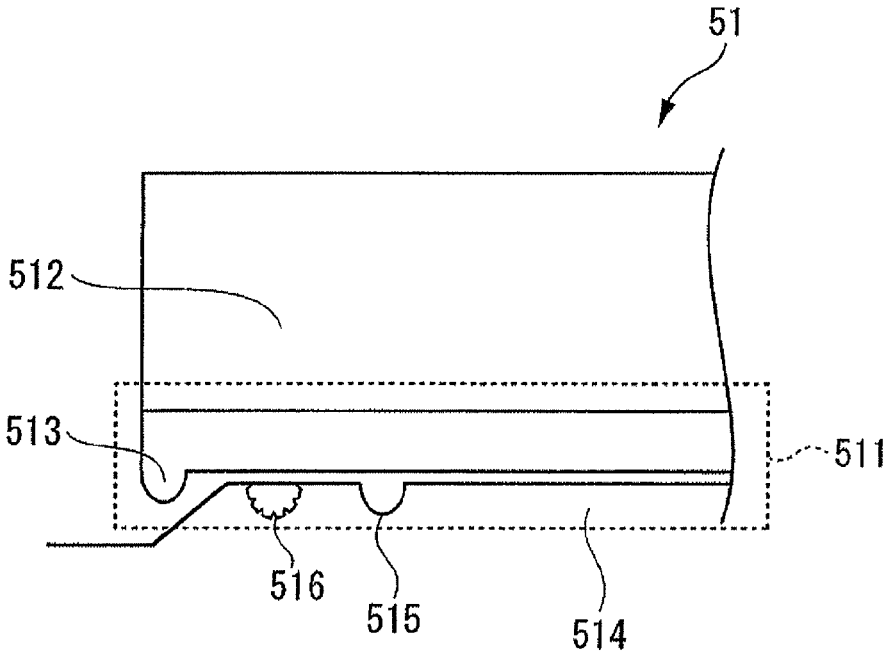
FIG. 4 is a modified case that illustrates a modified guide rail of a first sheet feeder cassette unit of an image forming apparatus in accordance with a first embodiment of the present invention.

For example, as shown in FIG. 4, when the second concave portion 516 including concave/convex portions is formed in a front side of the first sheet feeder cassette unit 51, i.e., in a side of the direction corresponding to the extraction direction of the first sheet feeder cassette unit 51, vibration (second vibration), which is different from the vibration (first vibration) generated when the convex portion 513 fits into the concave portion 515, is generated when the convex portion 315 fits into the second concave portion 516. The main control unit 10 may be configured to detect that the first sheet feeder cassette unit 51 is opened when detecting the first vibration after detecting the second vibration, and may be configured to detect that the first sheet feeder cassette unit 51 is closed when detecting the second vibration after detecting the first vibration. Further, the second concave portion 516 may be formed in the direction corresponding to the insertion direction of the first sheet feeder cassette unit 51 (the concave portion 516 is arranged in a proper position of the support unit 514 so that the convex portion 513 fits into the concave portion 516 before fitting into the concave portion 515 when the first sheet feeder cassette unit 51 is inserted.) Thus, the main control unit 10 detects that the first sheet feeder cassette unit 51 is closed when detecting the first vibration after detecting the second vibration, and detects that the first sheet feeder cassette unit 51 is opened when detecting the second vibration after detecting the first vibration. Likewise, the configurations similar to the above may be applied to the second sheet feeder cassette unit 21 and the third sheet feeder cassette unit.

In the first embodiment, although the convex portions are formed on the first sheet feeder cassette unit 51, the second sheet feeder cassette unit 21 and the third sheet feeder cassette unit 22, and the concave portions are formed on the support unit 514, the present invention is not limited to these configurations of the first embodiment.

For example, for the first sheet feeder cassette unit 51, a concave portion may be formed on a surface of the storage unit 512, and a convex portion may be formed on a surface of the support unit 513. Further, for the first sheet feeder cassette unit 51, convex portions may be formed on the surface of the storage unit 512 facing the support unit 514 and the surface of the support unit 51 facing the storage unit 512, so that the first sheet feeder cassette unit 51 is configured to generate the specific vibration pattern by making the convex portion of the storage unit 512 contact with the convex portion of the support unit 514 when the first sheet feeder cassette unit 51 is extracted or inserted. Likewise, the configuration of the first sheet feeder cassette unit 51 described above may be applied to the second sheet feeder cassette unit 21 and the third sheet feeder cassette unit 22.

Next, a second embodiment in accordance with the present invention will be described below with reference to FIGS. 5-8.

Figure 5:
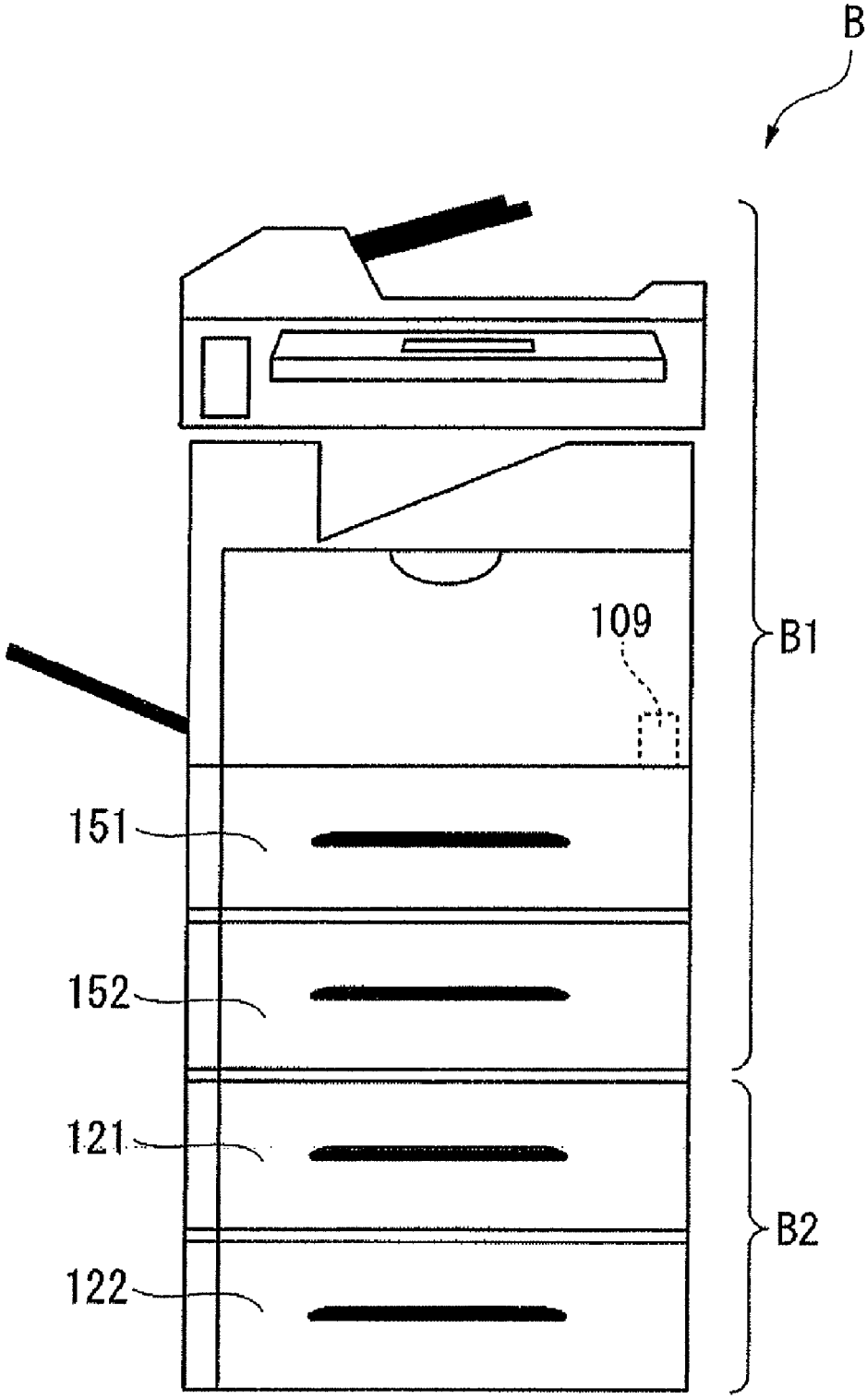
FIG. 5 is a drawing that illustrates a front view of an image forming apparatus in accordance with a second embodiment of the present invention.
Figure 6:
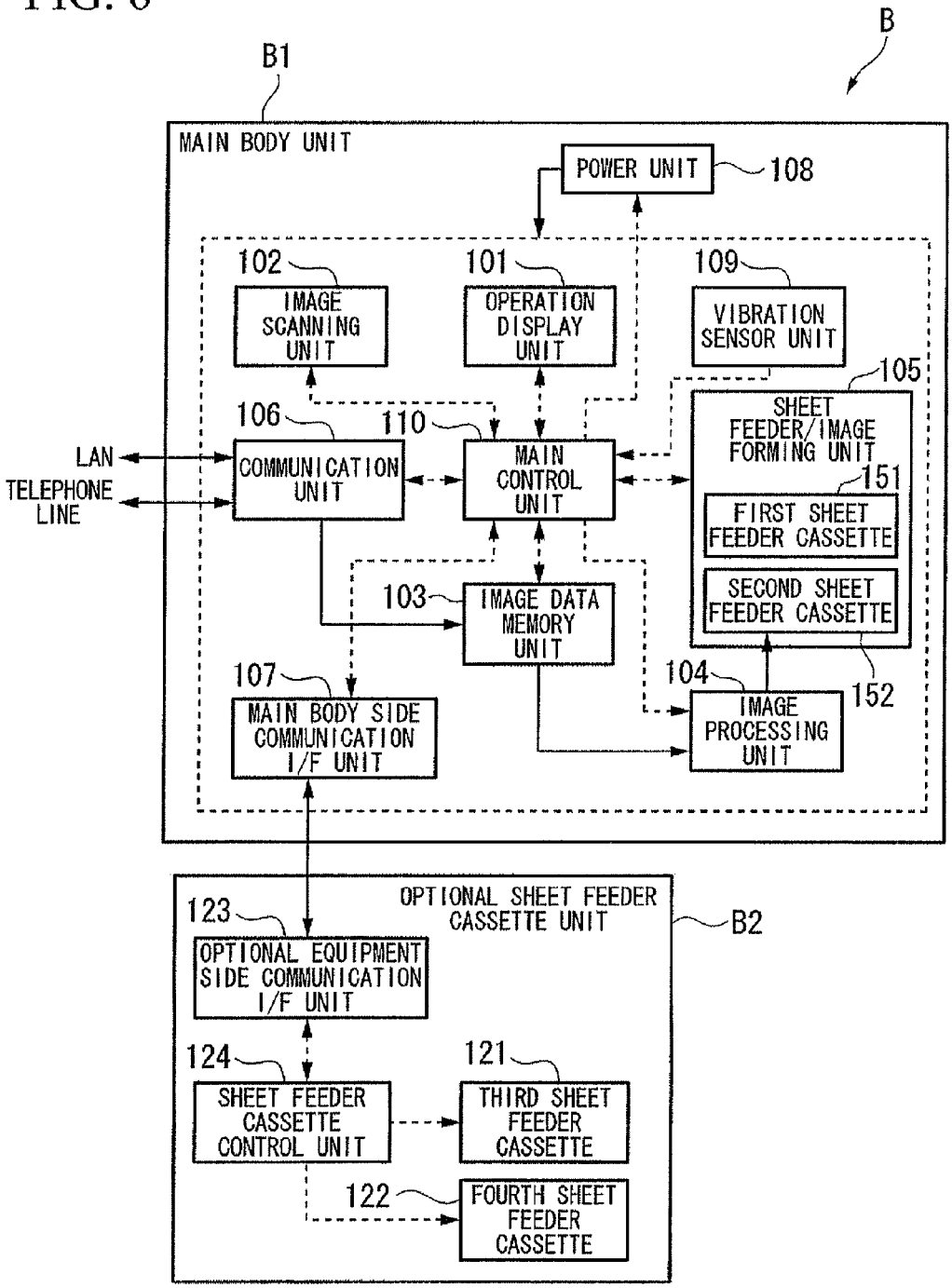
FIG. 6 is a drawing that illustrates a block diagram of an image forming apparatus in accordance with a second embodiment of the present invention.

A multifunctional apparatus (image forming apparatus) B according to the second embodiment includes a copy function, a print function, a scan function, a facsimile transmission/reception function and an email transmission function. As shown in FIGS. 5 and 6, the multifunctional apparatus B includes a main body unit B1 that performs the image forming process and an optional sheet feeder cassette unit B2 that supplies recording papers to the main body unit B1.

The main body unit B1 mainly performs the image forming process. As shown in FIG. 6, the main body unit B1 includes an operation display unit 101, an image scanning unit 102, an image data memory unit 103, an image processing unit 104, a sheet feeder/image forming unit 105, a communication unit 106, a main body side communication I/F unit 107, a power unit 108, a vibration sensor unit 109, and a main control unit 110. The main control unit 110 includes an open/close detection unit in accordance with the second embodiment.

The operation display unit 101 includes operation keys and a touch panel, which functions as an interface that associates between a user and the multifunctional apparatus A. The operation display unit 101 outputs an instruction signal of each pushed down key to the main control unit 110, and indicates various screens on the touch panel based on the control signals of the main control unit 110.

The image scanning unit 102 scans a manuscript (manuscript image) to read the image of the manuscript by using a line sensor, in which the manuscript is automatically fed by a document processor (DP: document processor or automatic manuscript feeder apparatus) based on a control signal input from the main control unit 110 or placed on a platen glass. The image scanning unit 102 converts the scanned image into a manuscript image data, and outputs the manuscript image data to the image data memory unit 103.

The image data memory unit 103 is a semiconductor memory or a hard disk drive apparatus. The image data memory unit 103 stores the manuscript image data, a print image data and a facsimile image data (receiving through the communication unit 106 from outside) based on the control signal input from the main control unit 110, and outputs those of image data to the image processing unit 104.

The image processing unit 104 performs various image processing (e.g., image processing of an enlarged or reduced copy) for the image data that is input from the image data memory unit 103 based on the control signal input from the main control unit 110. The image processing unit 104 converts the image data into an image data of an image formation format (image formation format data), and transmits the image formation format data to the sheet feeder/image forming unit 105. When the image scanning unit 102 reads a color manuscript, an image data from the image data memory unit 103 input to the image processing unit 104 becomes an RGB image data (color image data) corresponding to the three primary colors of light.

The image processing unit 104 converts the RGB image data into an image data corresponding to an image formation format (image formation format data), such as an YMCK image data that is an image data consisting of primary colors, i.e., Y(yellow), M(magenta), C(cyan), and K(black), and transmits the YMCK image data to the sheet feeder/image formation unit 105.

The sheet feeder/image formation unit 105 includes a first sheet feeder cassette unit 151 and a second sheet feeder cassette unit 152 which store a predetermined type of recording paper, a print engine (a photoconductor drum, an electrification unit, a development unit, a fixation unit or the like), a sheet feeder roller, and a paper exhaust roller, as shown in FIGS. 5 and 6. The sheet feeder/image formation unit 105 feeds the recording paper using the sheet feeder roller based on the control signal of the main control unit 110. The sheet feeder/image formation unit 105 transcribes an image on a recording paper based on the image data input from the image processing unit 104 and performs fixation the image on the recording paper. The sheet feeder/image formation unit 105 transfers the recording paper to the outside of the apparatus by the exhaust roller.

Figure 7A:
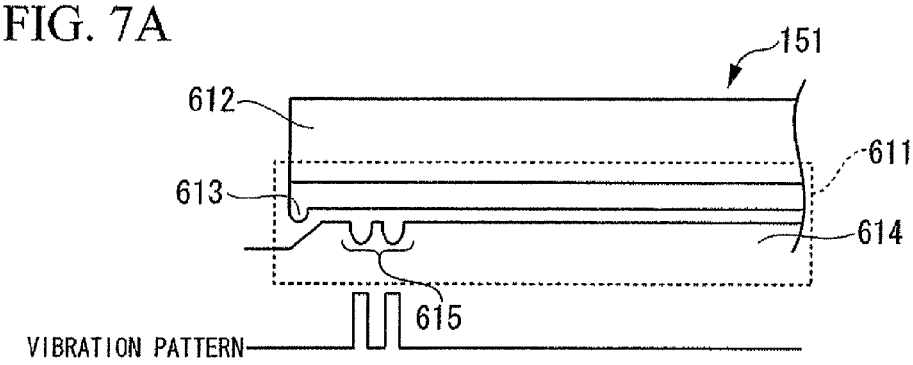
FIGS. 7A-7D are drawings that illustrate a side view of first, second and third sheet feeder cassette units of an image forming apparatus in accordance with a second embodiment of the present invention.

As shown in FIG. 7A, the first sheet feeder cassette unit 151 includes a guide rail 611, a paper storage unit 612, and a support unit 614. The guide rail 611 guides the paper storage unit 612 when the paper storage unit 612 is opened/closed. A convex portion 613 is formed on a surface of the paper storage unit 612, and a series of two concave portions 615 (first concave portions) is formed on a surface of the support unit 614. At the engagement surface of the guide rail 611, a specific vibration pattern is generated by making the convex portion 613 fit into the concave portion 615 when the paper storage unit 612 is extracted/inserted.

Figure 7B:
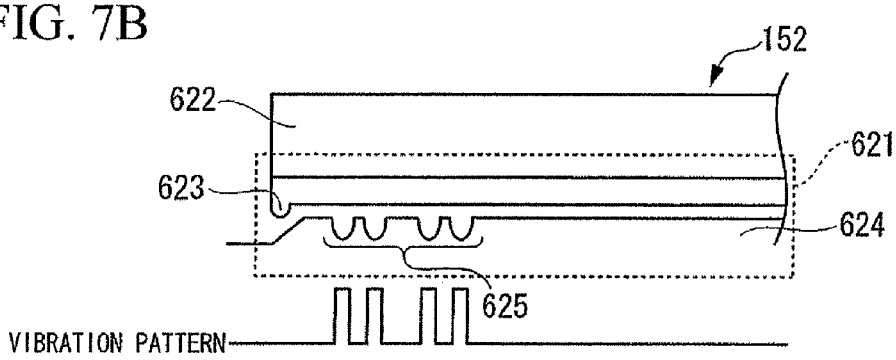

As shown in FIG. 7B, the second sheet feeder cassette unit 152 includes a guide rail 621, a paper storage unit 622, and a support unit 624. The guide rail 621 guides the paper storage unit 622 when the paper storage unit 622 is opened/closed. A convex portion 623 is formed on a surface of the paper storage unit 622, and concave portions (first concave portion) are formed on a surface of the support unit 624. Unlike the first sheet feeder cassette unit 151, the second sheet feeder cassette unit 152 includes two series of concave portions 625 each of which includes two concave portions as a pair. When the second sheet feeder cassette unit 152 is extracted/inserted, the convex portion 623 is fit into the concave portions 625 and generates a vibration pattern which is different from the vibration pattern of the first sheet feeder cassette unit 151. Therefore, the second sheet feeder cassette unit 152 is configured to generate the different vibration pattern.

The communication unit 106 can communicate with a facsimile machine, a client computer or the like by use of a LAN (Local Area Network) or a telephone line based on the control signal of the main control unit 110. In other words, the communication unit 106 includes both communication functions in accordance with the LAN standard such as the Ethernet (trade mark) and the facsimile standard such as the G3 (third generation) standard. For example, the communication unit 106 can perform transmission of electronic mails (Emails) or transmission/reception of facsimiles.

The main body communication I/F unit 107, which is connected to the optional sheet feeder cassette unit apparatus B2 through a serial cable, is an interface that communicates with the optional sheet feeder cassette unit apparatus B2 based on the control signal input from the main control unit 110.

The power unit 108 supplies electric power to the main body unit b1 and the optional sheet feeder cassette unit apparatus B2 based on the control signal input from the main control unit 110, in which the electric power is introduced from outside. As shown in FIG. 5, the vibration sensor unit 109 is arranged to face the first sheet feeder cassette unit 151 at the inside of the main body unit B1, and detects the vibration generated at the main body unit B1 and the optional cassette apparatus B2. The vibration sensor unit 109 outputs a detection signal to the main control unit 110 in response to a vibration pattern of the multifunctional apparatus B.

The main control unit 110 includes a CPU (Central Processing Unit), a ROM (Read Only Memory), a RAM (Random Access Memory), the operation display unit 101, the image scanning unit 102, the image data memory unit 103, the image processing unit 104, the sheet feeder/image forming unit 105, and an interface circuit performing signal input/output between the communication unit 106 and the main body communication I/F unit 107. The main control unit 110 performs the whole control of the multifunctional apparatus B based on the control program stored in the ROM and the operation instructions input from the operation display unit 101. Further, the control program stored in the ROM includes a trouble shooting program. The main control unit 110 performs a processing based on the trouble shooting program when failure is detected at the optional sheet feeder cassette unit apparatus B2 or the like. For the operations of the multifunctional apparatus B, a description will be given in detail based on the processing performed by the main control unit 110.

The optional sheet feeder cassette unit apparatus B2 is an optional apparatus that is removable, and stores recording papers which are conveyed to the sheet feeder/image forming unit 105. The optional sheet feeder cassette unit apparatus B2 includes a third sheet feeder cassette unit 121, a fourth sheet feeder cassette unit 122, a device side communication I/F unit 123 (an optional equipment side communication I/F unit 123) and a sheet feeder control unit 24, as shown in FIG. 6.

Figure 7C:
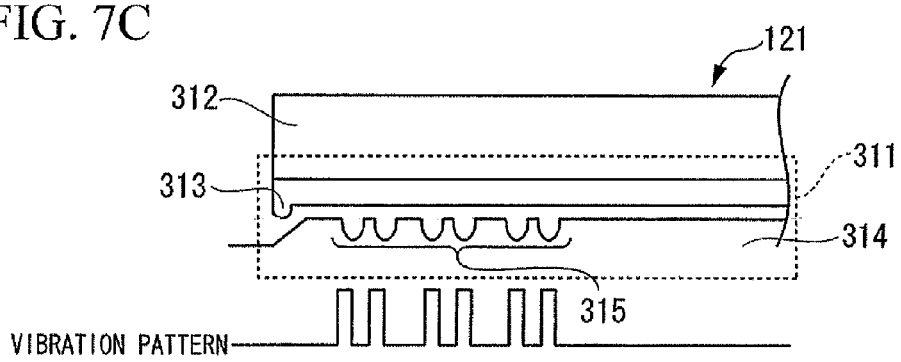

As shown in FIG. 7C, the third sheet feeder cassette unit 121 includes a guide rail 311, a paper storage unit 312, and a support unit 314. The guide rail 311 guides the third sheet feeder cassette unit 121 when the third sheet feeder cassette unit 121 is extracted/inserted for opening/closing the second sheet feeder cassette unit 121. A convex portion 313 is formed on a surface of the paper storage unit 312, and concave portions (first concave portion) are formed on a surface of the support unit 314. Unlike the first sheet feeder cassette unit 151 and the second sheet feeder cassette unit 152, the third sheet feeder cassette unit 121 includes two series of concave portions 315 each of which includes two concave portions as a pair. When the third sheet feeder cassette unit 121 is extracted/inserted, the convex portion 313 is fit into the concave portions 315 and generates a vibration pattern which is different from the vibration patterns of the first sheet feeder cassette unit 151 and the second sheet feeder cassette unit 152. The third sheet feeder cassette unit 121 is configured to generate the different vibration pattern.

Figure 7D:
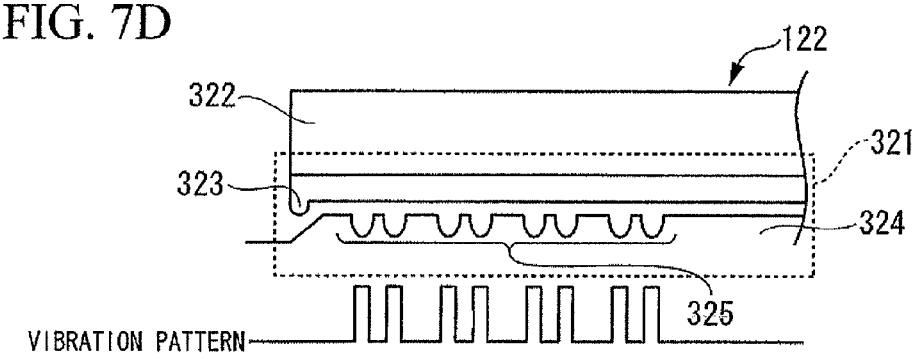

As shown in FIG. 7D, the fourth sheet feeder cassette unit 122 includes a guide rail 321, a paper storage unit 322, and a support unit 324. The guide rail 321 guides the fourth sheet feeder cassette unit 122 when the third sheet feeder cassette unit 122 is extracted/inserted for opening/closing the second sheet feeder cassette unit 122. A convex portion 323 is formed on a surface of the paper storage unit 322, and concave portions (first concave portion) are formed on a surface of the support unit 324. Unlike the first sheet feeder cassette unit 151, the second sheet feeder cassette unit 152 and the third sheet feeder cassette unit 121, the fourth sheet feeder cassette unit 122 includes a four series of concave portions 325 each of which includes two concave portions as a pair. When the fourth sheet feeder cassette unit 122 is extracted/inserted, the convex portion 323 is fit into the concave portions 325 and generates a vibration pattern which is different from the vibration patterns of the first sheet feeder cassette unit 151, the second sheet feeder cassette unit 152 and the third sheet feeder cassette unit 121. The third sheet feeder cassette unit 121 is configured to generate the different vibration pattern.

The device side communication I/F unit 123 is an interface that performs communication with the main body unit b1 based on a control signal input from the sheet feeder cassette unit control unit 124. The optional equipment side communication side I/F unit 123 is connected to the main body side communication I/F unit 107 via a serial cable.

The sheet feeder cassette unit control unit 124 includes a CPU, a ROM, a RAM, the third sheet feeder cassette unit 121, the fourth sheet feeder cassette unit 122, the device side communication I/F unit 123, and an interface circuit that performs signal input/output with the device side communication I/F unit 123. The sheet feeder cassette unit control unit 124 controls the total operations of the optional sheet feeder cassette unit apparatus B2 based on the control program stored in the ROM and the control signal input from the main control unit 110 via the device side communication I/F unit 123.

The operations of the multifunctional apparatus Bin accordance with the first embodiment, which include the configuration shown above, will be described in detail below.

In the multifunctional apparatus B, the main control unit 110 totally sets the multifunctional apparatus A in sleep mode when the operation display unit 101 is not operated by a user. In other words, the main control unit 110 suspends the power supply to each of units except the operation display unit 101, the vibration sensor unit 109 and the main control unit 110.

That is, the main control unit 10 makes the power unit 108 stop supplying the electric power to the image scanning unit 102, the image data memory unit 103, the image processing unit 104, the sheet feeder/image forming unit 105, the communication unit 106 and the main body side communication I/F unit 107. Further, the main control unit 110 stops supplying the electric power to the optional sheet feeder cassette unit apparatus B2 through the main body side communication I/F unit 107. Thereby, the optional sheet feeder cassette unit apparatus B2 becomes completely in a shutdown state. When the whole multifunctional apparatus B enters sleep mode, the main control unit 110 maintains the sleep mode until the operation display unit 101 receives an operation instruction or until the first sheet feeder cassette unit 151, the second sheet feeder cassette unit 152, the third sheet feeder cassette unit 121 of the optional sheet feeder cassette unit apparatus B2 or the fourth sheet feeder cassette unit 122 of the optional sheet feeder cassette unit apparatus B2 is opened or closed.

After the multifunctional apparatus B enters sleep mode, when the first sheet feeder cassette unit 151 is opened/closed by extraction or insertion, a specific vibration pattern is generated by the convex portion 613 fitting into the concave portions 515. When the second sheet feeder cassette unit 152 is opened/closed by extraction or insertion, a vibration pattern is generated, which is different from the vibration patter of the first sheet feeder cassette unit 151. Further, when the third sheet feeder cassette unit 121 is opened/closed by extraction or insertion, a vibration pattern is generated, which is different from the vibration patterns the first sheet feeder cassette unit 151 and the second sheet feeder cassette unit 152. When the fourth sheet feeder cassette unit 122 is opened/closed by extraction or insertion, a vibration pattern is generated, which is different from the vibration patterns of the first sheet feeder cassette unit 151, the second sheet feeder cassette unit 152 and the third sheet feeder cassette unit 121.

When the vibration sensor unit 109 detects a vibration pattern generated by opening or closing the first sheet feeder cassette unit 151, the second sheet feeder cassette unit 152, the third sheet feeder cassette unit 121 or the fourth sheet feeder cassette unit 122, the vibration sensor unit 109 transmits a detection signal in response to the vibration pattern to the main control unit 110.

When the main control unit 110 receives a detection signal from the vibration sensor unit 109, the main control unit 110 identifies the vibration pattern based on the detection signal and detects that the first sheet feeder cassette unit 151, the second sheet feeder cassette unit 152, the third sheet feeder cassette unit 121 or the fourth sheet feeder cassette unit 122 is opened/closed based on the vibration pattern. When the main control unit 110 detects that either the first sheet feeder cassette unit 151, the second sheet feeder cassette unit 152, the third sheet feeder cassette unit 121 or the fourth sheet feeder cassette unit 122 is opened/closed based on the vibration pattern, the main control unit 110 restores the multifunctional apparatus B from the sleep mode. In other words, the main control unit 110 makes the power unit 108 restart the supply of electric power to the image scanning unit 102, the image data memory unit 103, the image processing unit 104, the sheet feeder/image forming unit 105, the main body side communication I/F unit 107, and the optional sheet feeder cassette unit B2.

As is described above, in the multifunctional apparatus B in accordance with the second embodiment, the main control unit 110 identifies the vibration pattern based on the detection signal of the vibration sensor 109. When the main control unit 110 detects the specific vibration pattern based on the detection result of the vibration sensor unit 109, the main control unit 110 detects that either the first sheet feeder cassette unit 151, the second sheet feeder cassette unit 152, the third sheet feeder cassette unit 121 or the fourth sheet feeder cassette unit 122 is opened/closed. Accordingly, by detecting the opened/closed state of the first sheet feeder cassette unit 151, the second sheet feeder cassette unit 152, the third sheet feeder cassette unit 121 or the fourth sheet feeder cassette unit 122, there becomes no need to provide open/close sensors for each of the first sheet feeder cassette unit 151, the second sheet feeder cassette unit 152, the third sheet feeder cassette unit 121 and the fourth sheet feeder cassette unit 122, so that the power required to operate the open/close sensors can be reduced.

Furthermore, as there is no need to supply the electric power to the sheet feeder cassette unit control unit 124 of the optional sheet feeder cassette unit B2 while being in the sleep mode, the electric power required for the sheet feeder cassette unit control unit 124 can be reduced.

Up to now, the descriptions have been given for the second embodiment. However, the present invention is not limited to the above embodiment. Other modifications can be made, and which will be described below.

Although, in the second embodiment, there is no distinction made between an open state and a close state when detecting the open/close of the first sheet feeder cassette unit 151, the second sheet feeder cassette unit 152, the third sheet feeder cassette unit 121, and the fourth sheet feeder cassette unit 122, the present invention is not limited to these configurations.

Figure 8:
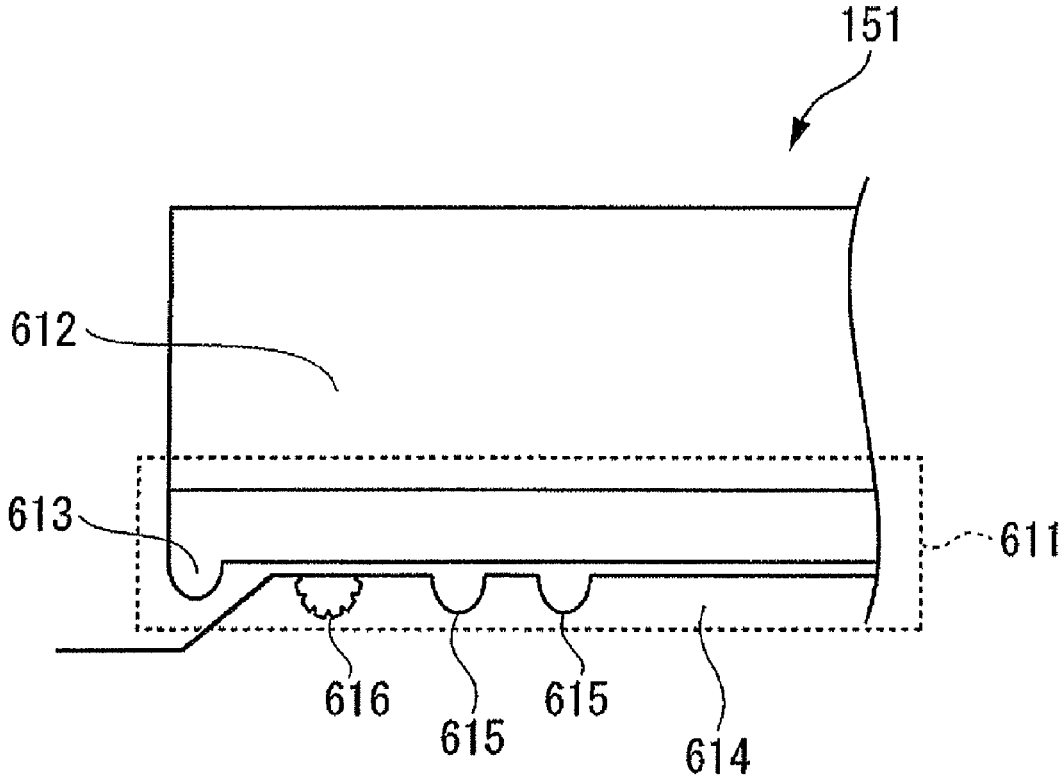
FIG. 8 is a drawing that illustrates a modified case which indicates a modified guide rail of a first sheet feeder cassette unit of an image forming apparatus in accordance with a second embodiment of the present invention.

For example, as shown in FIG. 8, when a second concave portion 616 having concave/convex surface is formed in a front side of the first sheet feeder cassette unit 151, i.e., in a side of the direction corresponding to the extraction direction of the first sheet feeder cassette unit 151, vibration (second vibration), which is different from the vibration (first vibration) generated when the convex portion 613 fits into the concave portion 615. The main control unit 110 may be configured to detect that the first sheet feeder cassette unit 151 is opened when detecting the first vibration after detecting the second vibration, and may be configured to detect that the first sheet feeder cassette unit 151 is closed when detecting the second vibration after detecting the first vibration. Further, the second concave portion 616 may be formed in the direction corresponding to the insertion direction of the first sheet feeder cassette unit 151 (the concave portion 616 is arranged in a proper position of the support unit 614 so that the convex portion 613 fits into the concave portion 616 before fitting into the concave portion 615 when the first sheet feeder cassette unit 151 is inserted.) Thus, the main control unit 110 detects that the first sheet feeder cassette unit 151 is closed when detecting the first vibration after detecting the second vibration, and detects that the first sheet feeder cassette unit 151 is opened when detecting the second vibration after detecting the first vibration. Likewise, the configurations similar to the above may be applied to the second sheet feeder cassette unit 152, the third sheet feeder cassette unit 121, and the fourth sheet feeder cassette unit 122.

In the above embodiment shown in FIG. 8, the convex portions are formed on the storage units of the first sheet feeder cassette unit 151, the second sheet feeder cassette unit 152, the third sheet feeder cassette unit 121 and the fourth sheet feeder cassette unit 122, while the concave portions are formed on the support unit 614, the present invention is not limited to these configurations of the above embodiment.

For example, for the first sheet feeder cassette unit 151, a concave portion may be formed on a surface of the storage unit 612, and a convex portion may be formed on a surface of the support unit 613. Further, for the first sheet feeder cassette unit 151, convex portions may be formed on the surface of the storage unit 612 facing the support unit 614 and the surface of the support unit 151 facing the storage unit 612, so that the first sheet feeder cassette unit 151 is configured to generate the specific vibration pattern by making the convex portion of the storage unit 612 contact with the convex portion of the support unit 614 when the first sheet feeder cassette unit 151 is extracted or inserted. Likewise, the configuration of the first sheet feeder cassette unit 151 described above may be applied to the second sheet feeder cassette unit 152, the third sheet feeder cassette unit 121, and the fourth sheet feeder cassette unit 122.

In view of the above, it will be apparent to those skilled in the art from this disclosure that there exists a need for an improved apparatus and/or method. This invention addresses this need in the art as well as other needs, which will become apparent to those skilled in the art from this disclosure.

As used herein, the following directional terms "forward, rearward, above, downward, vertical, horizontal, below, and transverse" as well as any other similar directional terms refer to those directions of an apparatus equipped with the present invention. Accordingly, these terms, as utilized to describe the present invention should be interpreted relative to an apparatus equipped with the present invention.

The term "configured" is used to describe a component, section or part of a device includes hardware and/or software that is constructed and/or programmed to carry out the desired function.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. An image forming apparatus, which is configured to include a sheet feeder cassette unit being opened or closed by extracting or inserting the sheet feeder cassette unit, comprising:

a vibration sensor configured to transmit detection signals in response to vibration patterns; and an open/close detection unit configured to detect an open/close state of the sheet feeder cassette unit based on a detection result of the vibration sensor, wherein the sheet feeder cassette unit generates a first specific vibration pattern when the sheet feeder cassette unit is opened or closed, and the open/close detection unit identifies the first specific vibration pattern based on a detection signal of the vibration sensor and detects the open/close state of the sheet feeder cassette unit based on an identification of the first specific vibration pattern.

2. The image forming apparatus according to claim 1, wherein the sheet feeder cassette unit generates a second specific vibration pattern being different from the first specific vibration pattern when the sheet feeder cassette unit is opened or closed, and the open/close detection unit identifies the first specific vibration pattern and the second vibration pattern based on the detection signal of the vibration sensor, and identifies the open/close state of the sheet feeder cassette unit based on a detection order of the first specific vibration pattern and the second specific vibration pattern.

3. The image forming apparatus according to claim 1, wherein a convex portion is formed on one side surface of an engagement surface of a guide rail of the sheet feeder cassette unit and another first concave portion or another convex portion is formed on another side surface of the engagement surface, and the first specific vibration pattern is generated by making the convex portion of the one side surface fit into the first concave portion or making the convex portion of the one side surface contact with another convex portion of another side surface when the sheet feeder cassette unit is extracted or inserted.

4. The image forming apparatus according to claim 3, further comprising:

a second concave portion configured to generate a second specific vibration pattern being different from the first specific vibration pattern, the second concave portion being formed for an extraction direction or an insertion direction on another surface being opposite to the convex portion on the one side of surface at the engagement surface of the guide rail of the sheet feeder cassette unit, wherein the second specific vibration pattern is generated when the sheet feeder cassette unit is extracted or inserted by making the convex portion of the one side surface fit into the second concave potion, and the open/close detection unit identifies the open/close state of the sheet feeder cassette unit based on a detection order of the first specific vibration pattern and the second specific vibration pattern.

5. The image forming apparatus according to claim 1, further comprising:

a plurality of sheet feeder cassette units configured to store recording papers, the plurality of sheet feeder cassette units being configured to generate a plurality of first specific vibration patterns being different from one another when each of the plurality of sheet feeder cassette units is opened or closed by extraction or insertion, wherein the open/close detection unit identifies each of the first specific vibration patterns based on a detection signal of the vibration sensor, and identifies that a sheet feeder cassette unit is opened or closed based on each of the first specific vibration patterns.

6. The image forming apparatus according to claim 5, wherein a convex portion is formed on one side surface of an engagement surface on a guide rail of each of the sheet feeder cassette units, each of the first concave portions having patterns or each of other convex portions having patterns is formed on another side surface of the engagement surface on the guide rail of each of the sheet feeder cassette units, each of the first specific vibration patterns of the sheet feeder cassette units is generated by making the convex portion of the one side surface fit into the first concave portions or making the convex portion of the one side surface contact with other convex portions of another side surface when each of the paper cassette is extracted or inserted.

7. The image forming apparatus according to claim 6, wherein second concave portions are formed on each of the sheet feeder cassette units in an extraction direction or an insertion direction of another surface on the engagement surface on the guide rail of each of the sheet feeder cassette units, the second concave portions face the convex portion formed on the one surface of the engagement surface on the guide rail of each of the sheet feeder cassette units, the second concave portions are configured to generate second vibration patterns, each of the second vibration patterns is different from each of the first vibration patterns, each of the second vibration patterns is generated for each of the sheet feeder cassette units by that the convex portion of the one surface is fit into the second concave portions while each of the sheet feeder cassette units is extracted or inserted, and the open/close detection unit identifies the open/close state of each of the sheet feeder cassette units in response of an detection order of the first specific vibration pattern and the second specific vibration pattern.

8. The image forming apparatus according to claim 1, further comprising:

a main body unit configured to include the vibration sensor and the open/close detection unit;

an optional sheet feeder cassette unit configured to include a sheet feeder cassette unit; and a power control unit configured to control electric power supplied to the main body unit, the optional sheet feeder cassette unit, the power control unit being provided on the main body unit, wherein the power control unit stops supplying the electric power to the optional sheet feeder cassette unit when the image forming apparatus is in sleep mode.

* * * * *